US005727272A

United States Patent [19]

Peter

[11] Patent Number: 5,727,272

[45] Date of Patent: Mar. 17, 1998

[54] COMPOSITE STRUCTURE, ESPECIALLY BRIDGE

[76] Inventor: Emil Peter, Dammweg 314, CH-8460 Marthalen, Switzerland

[21] Appl. No.: 543,852

[22] Filed: Oct. 12, 1995

[30] Foreign Application Priority Data

Oct. 12, 1994 [CH] Switzerland ..... 3065/94

[51] Int. Cl.[6] ..... E01D 6/00

[52] U.S. Cl. ..... 14/6; 14/13; 52/633; 52/644

[58] Field of Search ..... 14/2, 3, 4, 9, 11, 14/13, 14, 15, 6, 12, 77.1; 52/633, 644, 86, 87, 88, 638, 642, 639, 643

[56] References Cited

U.S. PATENT DOCUMENTS

| | | | |
|---|---|---|---|
| 1,788,183 | 1/1931 | Asleson | 52/644 |
| 4,173,857 | 11/1979 | Kosaka | 52/644 X |
| 4,275,537 | 6/1981 | Pinson | 52/644 X |
| 4,393,637 | 7/1983 | Mosier | 52/644 |
| 4,649,688 | 3/1987 | Mosier | 52/644 |
| 4,924,638 | 5/1990 | Peter . | |
| 5,317,856 | 6/1994 | Peter . | |

FOREIGN PATENT DOCUMENTS

| | | | |
|---|---|---|---|
| 963625 | 3/1975 | Canada | 52/644 |
| 638358 | 5/1991 | Switzerland . | |

*Primary Examiner*—James Lisehora
*Attorney, Agent, or Firm*—Diller, Ramik & Wight, PC

[57] ABSTRACT

The composite structure made of wood and reinforced concrete can be used for bridges, roofs etc. In a bridge, a plate of reinforced concrete carries the roadway and rests on a truss comprising lower and upper chords, transversal girders and struts made of wood and posts made of reinforced concrete. The lower struts are reinforced with steel ties, follow a bent curve and are anchored in lateral end sections. Forces in the wooden parts all extend along the wood's fibre, which increases the maximum load capacity. The concrete posts allow a simple assembly of the wooden elements. The weight of the construction is low, its load bearing capacity high.

10 Claims, 3 Drawing Sheets

COMPOSITE STRUCTURE, ESPECIALLY BRIDGE

BACKGROUND OF THE INVENTION

1. Field of the Invention

The invention relates to a composite structure, especially a bridge, of wood and reinforced concrete.

2. Description of the Prior Art

Modern bridges are conventionally built with reinforced concrete. Their construction is, however, complicated. First, a wood scaffold must be constructed for carrying the form for the concrete. Then the concrete must be cast and the scaffold must be removed after the concrete has hardened.

A further considerable disadvantage of conventional constructions of reinforced concrete lies in the fact that the steel cables are not visible for inspection since they lie within the concrete.

Another construction is described in CH 683 358 and U.S. Pat. No. 5 317 856. CH 683 358 describes a bridge with a plate of reinforced concrete for receiving the roadway and a support structure below the plate. The support structure consists of vertical plates of reinforced concrete or wood. The maximum load and/or span of this structure is low since the plates are comparatively heavy and because the wood must support forces directed across its grain or fibre.

SUMMARY OF THE INVENTION

Hence, it is a general object of the invention to provide a an elongate composite structure of wood and reinforced concrete for bridges, roofs and the like that avoids at least part of these disadvantages.

Now, in order to implement these and still further objects of the invention, which will become more readily apparent as the description proceeds, the structure is manifested by the features that it comprises an upper reinforced concrete plate and a supporting truss disposed below said plate, said truss comprising longitudinal and transversal girders of wood and posts of reinforced concrete, wherein said posts connect said plate with intersection points of said girders.

The posts of reinforced concrete guarantee a good connection between the plate and the girders while not being heavy. Since they are made of reinforced concrete and not of wood, they can easily be connected to the girders without slippage or clearance.

Since the truss consists of individual girders, posts, and eventually struts, it is lighter than conventional constructions where large, plate-like elements of wood and/or concrete are used.

Steel ties can be used for reinforcing the longitudinal girders and especially the lower chords. They can be guided laterally along the chords where they are easily accessible for inspection.

If fitted bolts are used for connecting the wooden elements inter se and with the concrete parts, which bolts are first inserted into the wood and then cast into the concrete, the construction work is simplified considerably.

Preferably, the steel ties and the lower chords, respectively, are anchored at their ends in reinforced concrete and not in the upper chords. This avoids forces transversal to the grain or fibre and increases the load that can be carried by the construction.

Finally, the used wood is an environmentally unproblematic building material and its application has commercial advantages.

BRIEF DESCRIPTION OF THE DRAWING

The invention will be better understood and objects other than those set forth above will become apparent when consideration is given to the following detailed description thereof. Such description makes reference to the annexed drawings, wherein.

DESCRIPTION OF THE PREFERRED EMBODIMENTS

In all figures dots are used for indicating areas filled with reinforced concrete.

Figure 1:
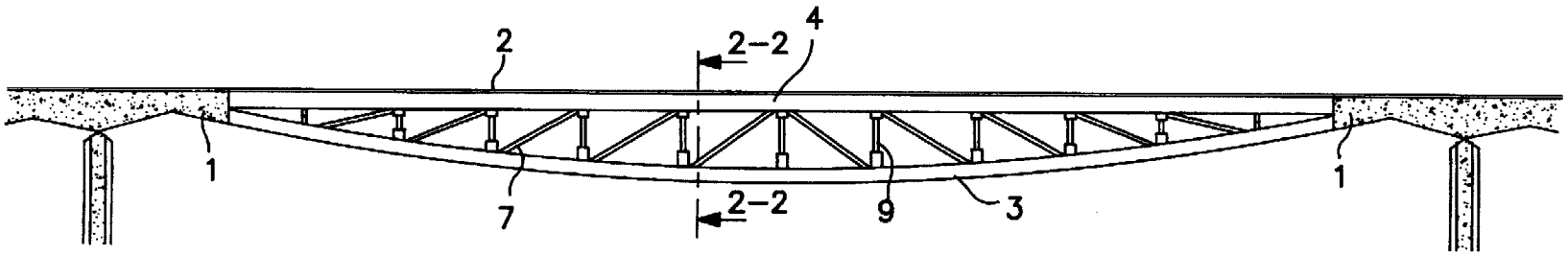
FIG. 1 a longitudinal section of a bridge according to this invention.
Figure 2:
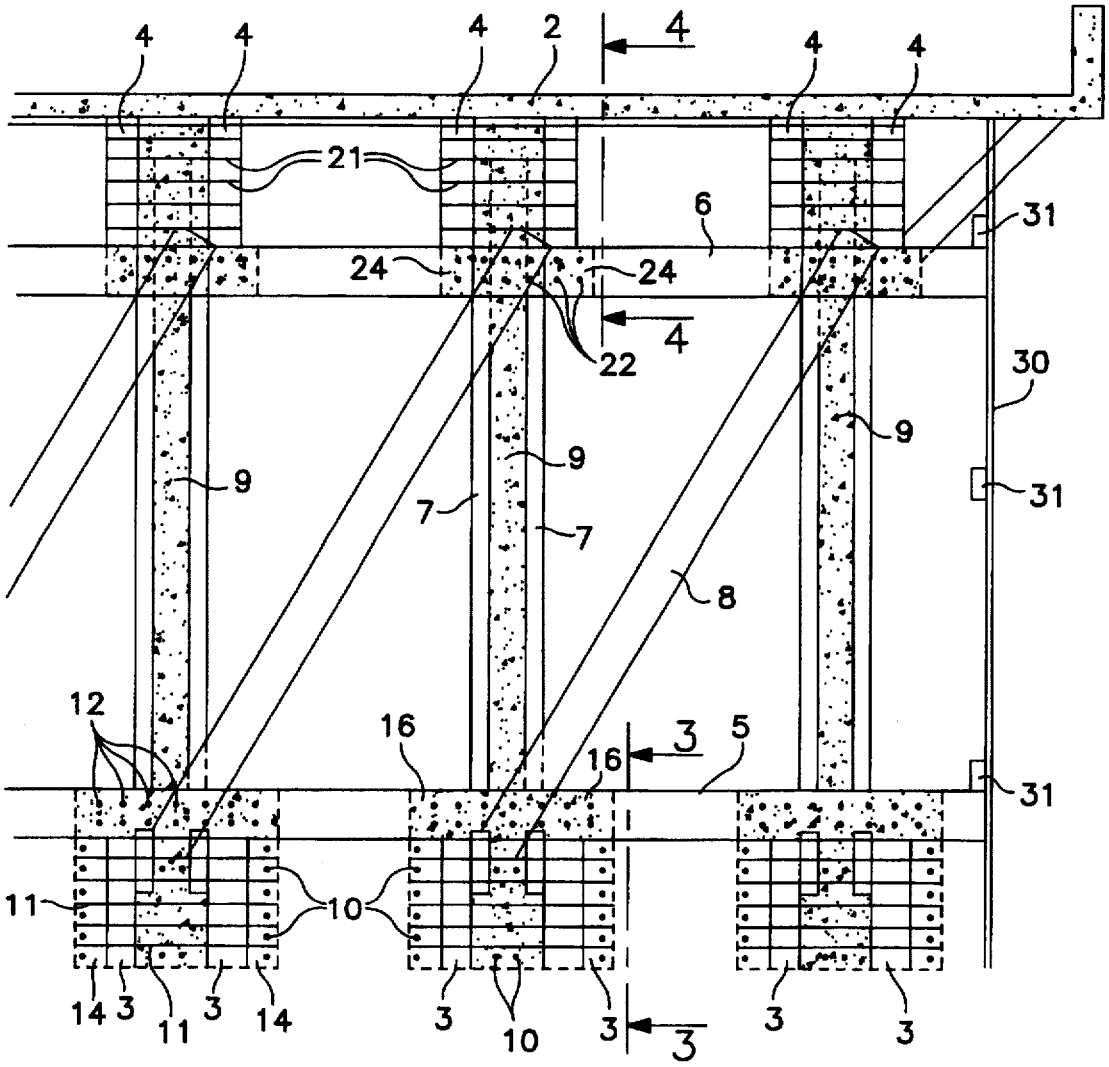
FIG. 2 a section along line 2—2 of FIG. 1.

The figures show a preferred embodiment of an inventive street bridge having a span of e.g. 90 meters. As can be seen from FIG. 1, the bridge extends between two lateral supports 1 of reinforced concrete. It comprises a plate 2 of reinforced concrete lying on top of it and carrying the roadway, as well as a supporting truss or framing arranged below plate 2. The supporting truss comprises longitudinal girders 3, 4, transversal girders 5, 6 (see FIG. 2), longitudinal struts 7 (FIG. 1) and transversal struts 8 (FIG. 2) as well as vertical posts 9. While the girders and struts 3–8 are made of wood, preferably stacked or laminated wood, posts 9 are made of steel-reinforced concrete. The longitudinal girders consist of lower chords 3 and upper chords 4 (FIG. 2).

Figure 3:
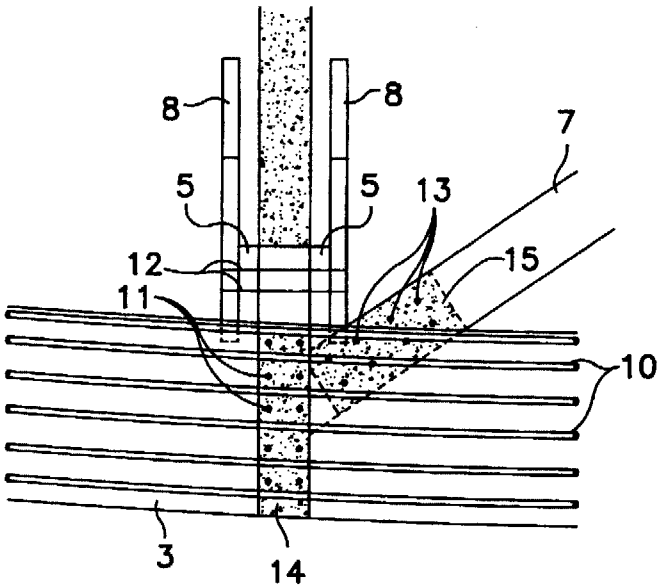
FIG. 3 a section through the lower part of the bridge along line 3—3 of FIG. 2.

The lower chords 3 are substantially running along the bent curve of a hanging rope and are substantially exposed to longitudinal pulling forces only. As it can especially be seen from FIGS. 2 and 3, each lower chord 3 is formed by a twin wood profile of two parallel wooden beams. Steel ties 10 are running on both lateral sides of each lower chord and within its twin profile. Each steel tie 10 extends over the whole length of the bridge and is anchored in the lateral supports 1. Anchoring the steel ties 10 in the upper chords 4 is not preferred since this would lead to unwanted forces transversal to the wood's grain or fibre.

The lower chords 3 are interconnected by lower transversal girders 5. Each lower transversal girder 5 is formed by a twin profile of wood. A concrete post 9 is standing in each intersection between lower chords 3 and transversal girders 5. It extends between the twin profiles of lower chord 3 and transversal girder 5 and is connected thereto by means of fitting bolts 11 and 12, which run perpendicularly through the twin wood profile and its concrete core. Laterally to each lower chord wooden reinforcing members 14 are mounted at each intersection, which are penetrated by the fitting bolts 11 and also by the steel ties 10. Each reinforcing member 14 transfers part of the vertical forces from the concrete post 9 to the steel ties 10.

Figure 4:
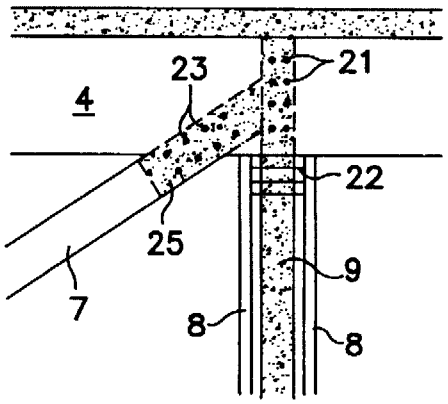
FIG. 4 a section through the upper part of the bridge along line 4—4 of FIG. 2, and FIG. 5 a longitudinal section through the end of the chords.

Longitudinal struts 7 and transversal struts 8 are arranged at each intersection between the lower chords 3 and the transversal girders 5. Each strut 7, 8 consists of a twin wood profile. As can be seen from FIG. 4, a projection 15 of the corresponding concrete post 9 (indicated by dots) is extending laterally and upwardly between the twin profile of longitudinal strut 7. Longitudinal strut 7 and projection 15 are interconnected by fitting bolts 13. The beams of twin profile of the transversal struts 8 end on both sides of the transversal girders 5 and are connected thereto by means of some of the fitting bolts 12.

Above chords 3 each post 9 forms two lower brackets 16 of reinforced concrete, which are extending outwardly between the twin profiles of the transversal girders 5. They form a support for post 9 on the corresponding lower chord 3 such that larger vertical forces can be supported.

At their upper ends the posts 9 are running through the twin profiles of the upper chords 4, the upper transversal girder 6 and the upper ends of the longitudinal struts 7 and the transversal struts 8 and are connected thereto by means of fitting bolts 21, 22 and 23, respectively. Each post 9 forms upper brackets 24 of reinforced concrete which extend into the upper transversal girders 6, as well as an upper projection 25 extending laterally and downwardly into the twin profile of longitudinal strut 7. The upper brackets act as a support for the upper chords 4.

Each post 9 is rigidly anchored in plate 2. Thus, plate 2 can add a reinforcing contribution to the whole truss or framing. Especially, it can prevent a deformation of the upper chords 4.

Screening walls 30 (see FIG. 2, not shown in FIG. 1) are arranged along both sides of the bridge. They are supported by wall girders 31 and preferably are able to carry their own weight. They consist e. g. of plates of wood or aluminum and protect the wooden elements 3–8 from rain and sun.

Figure 5:
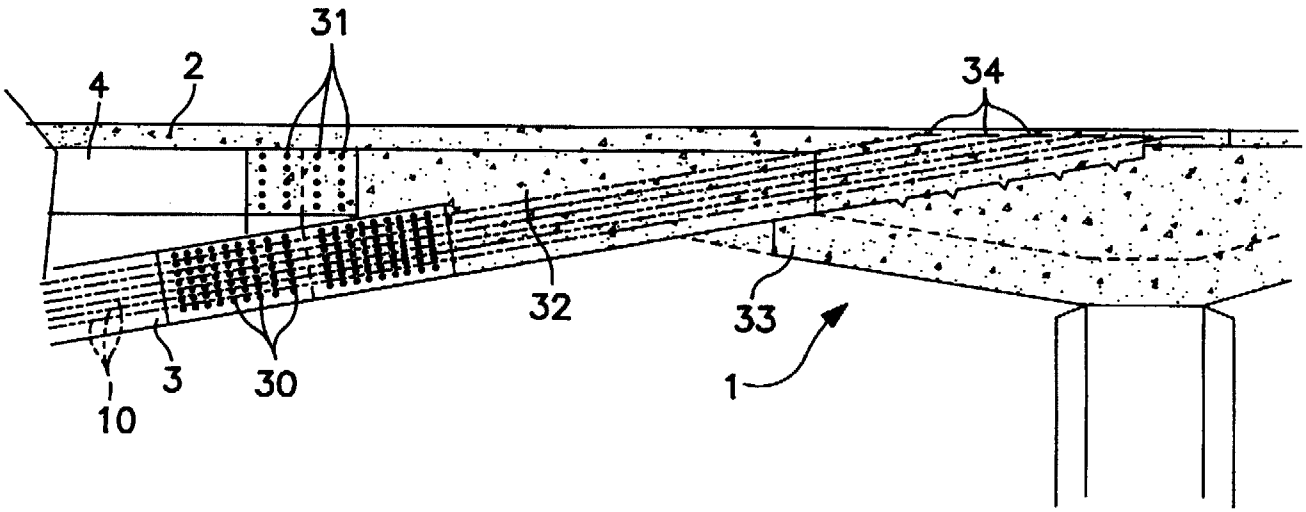

FIG. 5 shows a longitudinal section through the bridge at one of its lateral supports. As can be seen clearly, lower and upper chords 3, 4 are connected to an end section 32 made of reinforced concrete by means of fitting bolts 30 and 31, respectively. End section 32 rests on a support 33.

The steel ties 10 are led through the end sections 32 and further into plate 2, where they are anchored by means of anchors 34.

The bridge according to this invention is assembled as follows:

First, the truss consisting of longitudinal girders (chords) 3 and 4, transversal girders 5, 6, struts 7, 8, posts 9 and end sections 32 is assembled. This step is not carried out in-situ on the building site but in a suitable fabrication plant. As soon as the concrete parts are hardened, the transversal girders 5, 6 as well as the transversal struts 8 are individually marked and then disassembled from the structure by removing their fitting bolts such that the truss is divided into individual longitudinal elements, each comprising a lower chord 3, and upper chord 4 and the posts 9 and struts 7 extending there between. These longitudinal elements are then transported to the building site, where they are suspended between the supports. Then, the transversal girders 5, 6 and the struts 8 are mounted in their original positions such that the truss is complete.

The fully assembled truss can then be used as a scaffold for forming plate 2. The truss is dimensioned such that it is able to support the weight of plate 2 in its unhardened state. Once plate 2 has hardened, the structure achieves its full stability.

Since the parts of the truss are connected at their intersection points by means of fitting bolts 11–13 and 21–23 held in concrete, the positioning of which occurs before casting the concrete posts 9, the assembly work is simplified. This assembly of members of wood and concrete is more closely described in CH 683 358.

The time for assembly on the building site is decreased by the possibility of a partial pre-fabrication as described above.

In the bridge shown here, all major forces in the wooden elements are directed along the wood's fibres. The concrete posts guarantee a tight, stable connection between the lower and the upper chords and the plate. They penetrate each point of intersection of the truss. The plate distributes the weight of the load over the truss and counteracts plastical deformations of the wooden elements.

Because of the used truss technique with slim girders, struts and posts, the weight of the bridge is low.

The bridge offers an economically advantageous alternative to conventional constructions.

While there is shown and described a presently preferred embodiment of the invention, it is to be distinctly understood that the invention is not limited thereto but may be otherwise variously embodied and practiced within the scope of the following claims.

I claim:

1. An elongate composite structure of wood and reinforced concrete comprising an upper reinforced concrete plate and a supporting truss disposed below said plate, said supporting truss including:

upper and lower chords of wood extending longitudinally along said supporting truss, said lower chords being disposed below and at least partially relatively spaced from said upper chords, upper and lower transverse girders of wood, said upper transverse girders transversely interconnecting said upper chords at upper intersection points and said lower transverse girders transversely interconnecting said lower chords at lower intersection points, vertical posts of reinforced concrete connecting said plate and said intersection points, each vertical post extending continuously from a lower end located at one of said lower intersection points to and through an upper one of said upper intersection points, and concrete anchoring means between each post upper end and said concrete plate for rigidly anchoring said posts and plate together.

2. The elongated composite structure of claim 1, wherein said lower chords are reinforced with steel ties running parallel to said lower chords.

3. The elongated composite structure of claim 2 further comprising end sections of reinforced concrete, said lower chords extend substantially along the curve of a rope and are anchored at opposite ends in said end sections, and said steel ties extend through said end sections and are anchored in said reinforced concrete plate.

4. The elongated composite structure of claim 1, wherein each of said posts includes at least one lower bracket of reinforced concrete lying on a top side of one of said lower chords.

5. The elongated composite structure of claim 1, wherein said upper chords extend along and are immediately below said plate.

6. The elongated composite structure of claim 5, wherein each of said vertical posts comprises at least one upper bracket of reinforced concrete, and said upper chord lies on a top side of one of said upper brackets.

7. The elongated composite structure of claim 1, wherein said supporting truss includes a plurality of struts obliquely extending between one of said upper intersection points and one of said lower intersection points.

8. The elongated composite structure of claim 7, wherein each of said lower chords defines a chord pair with one of said upper chords, said lower chord of each chord pair being arranged vertically below said upper chord of said chord pair, a first part of said struts extend between upper and lower chords of the same chord pair, and a second part of said struts extend between upper and lower chords of neighboring chord pairs.

9. The elongated composite structure of claim 1, wherein said lower chords are reinforced with steel ties, reinforcing members at each lower intersection point arranged laterally to said lower chords, fitting bolts extend transversely through said lower chords and said reinforcing members, said steel ties extend through said reinforcing members, each of said vertical posts includes lower brackets of reinforced concrete, and each lower bracket lies on a top side of one of said lower chords and of one of said reinforcing members.

10. The elongated composite structure of claim 1 comprising lateral walls extending longitudinally along said truss for laterally covering said truss.

* * * * *